US007513915B2

(12) United States Patent
Schneider et al.

(10) Patent No.: US 7,513,915 B2
(45) **Date of Patent: *Apr. 7, 2009**

(54) PROCESS FOR STAIN REMOVAL

(75) Inventors: David J. Schneider, Union, KY (US); Charles A Schneider, Villa Hills, KY (US)

(73) Assignee: Schneider Advanced Technologies, Inc., Union, KY (US)

( * ) Notice: Subject to any disclaimer, the term of this patent is extended or adjusted under 35 U.S.C. 154(b) by 167 days.

This patent is subject to a terminal disclaimer.

(21) Appl. No.: 11/473,892

(22) Filed: Jun. 23, 2006

(65) Prior Publication Data

US 2006/0276672 A1 Dec. 7, 2006

Related U.S. Application Data

(63) Continuation of application No. 10/369,175, filed on Feb. 18, 2003, now Pat. No. 7,465,829, and a continuation-in-part of application No. 10/717,756, filed on Nov. 20, 2003, now abandoned.

(60) Provisional application No. 60/428,543, filed on Nov. 22, 2002.

(51) Int. Cl.
*D06L 1/00* (2006.01)

(52) U.S. Cl. ..... 8/137; 8/108.1

(58) Field of Classification Search ..... 8/108.1, 8/137

See application file for complete search history.

(56) References Cited

U.S. PATENT DOCUMENTS

| | | | | |
|---|---|---|---|---|
| 4,079,016 | A * | 3/1978 | Brahm et al. | 510/230 |
| 4,532,063 | A * | 7/1985 | Gueldenzopf | 252/186.35 |
| 4,723,961 | A * | 2/1988 | Bernhardt | 8/650 |
| 5,643,861 | A * | 7/1997 | de Guertechin et al. | 510/365 |
| 6,812,199 | B2 * | 11/2004 | Dasque et al. | 510/439 |
| 2003/0162755 | A1 | 8/2003 | Schneider et al. | |
| 2004/0102348 | A1 | 5/2004 | Schneider et al. | |
| 2005/0287109 | A1 | 12/2005 | Schneider et al. | |

FOREIGN PATENT DOCUMENTS

| | | | |
|---|---|---|---|
| EP | EP 0315204 | A2 * | 5/1989 |
| EP | 0315204 | A2 | 10/1989 |
| JP | 2001322902 | A * | 11/2001 |
| JP | 2002322902 | A | 11/2001 |

* cited by examiner

*Primary Examiner*—Lorna M Douyon
(74) *Attorney, Agent, or Firm*—Richard M. Klein; Fay Sharpe LLP

(57) ABSTRACT

Disclosed are processes whereby stains on a variety of substrates may be removed by treating a stained area of a substrate with a solution of a sulfonamide compound. The sulfonamide-containing solutions are particularly useful as stain removal agents for stains which originate with body fluids such as blood, urine, vomit, feces etc. The stain removal solutions may be buffered to a predetermined pH. The stain removal solutions may further incorporate small percentages of low molecular weight alcohols and wetting agents.

41 Claims, No Drawings

PROCESS FOR STAIN REMOVAL

RELATED APPLICATIONS

This application is a continuation in part application of application Ser. No. 10/369,175 filed Feb. 18, 2003 now U.S. Pat. No. 7,465,829 and of application Ser. No. 10/717,756 filed Nov. 20, 2003 now abandoned which application claims priority of Provisional Application Ser. No. 60/428,543 Filed Nov. 22, 2002.

BACKGROUND OF THE INVENTION

This invention is concerned with the removal of stains from various substrates. The stain removal is effected in such a manner that the substrate is not degraded or adversely affected. An important embodiment of this invention is the removal of stains from textiles and in particular clothing, carpeting and bedding. The invention is particularly useful in connection with stains which are of the human or animal origin i.e. stains which originate from or are caused by body fluids or solids such as urine, perspiration, feces, blood, vomit etc.

In its broadest sense the dyeing of a substrate can be considered to be the reaction of a chemical compound with a substrate wherein the color of the substrate is altered by the compound. In the usual sense the color of a substrate is altered in order to achieve a particular result i.e. a textile is reacted with a chemical compound (a dye) in order to change the color of the textile.

Almost as soon as man learned how to weave cloth man further learned how to decorate the cloth by changing its color, by dyeing. The most basic dyeing process consisted of soaking the cloth, i.e. a piece of clothing, in a solution of a natural dye. Examples of natural dyes are compounds which are obtained from animal or plant sources.

Most dyes used today are synthetic. The dyeing of a substrate is usually intentional such as the dyeing of fabric from which clothing is subsequently manufactured.

Changing or altering the dye structure of a substrate can also be accidental and hence undesirable. An area of a substrate which has a section, which has been unintentionally altered in its appearance, is referred to as a stain. Stains generally are not easily removed by simple laundering. However if altered sufficiently the stain can be removed either by laundering or some similar treatment. This invention is concerned with the modification and removal of stains from a variety of substrates. An important use of this invention is the removal of undesirable stains from institutional items such as uniforms worn by food service workers, health care workers and hospital and hotel bedding. Another area where this invention is useful is the removal of pet stains from carpet, upholstery, drapery and flooring.

Stains in accordance with this invention are removed, or rendered removable, by exposure of the stain to solutions of sulfonamide compounds and mixtures of sulfonamide compounds. Chloramine-T is a sulfonamide compound which is particularly useful in stain removal in accordance with this invention.

PRIOR ART

Stain removal in the prior art has been effected by exposing a stained substrate to a bleaching agent or to sunlight. A bleaching agent implies an alteration of stain by the removal of color. Sunlight is the original bleaching agent which is one reason why clothes were hung out to dry. In the last eighty years solutions of sodium hypochlorite have become widely accepted as bleaching agents. These solutions are commonly referred to as bleach. While the use of bleach has become widely accepted, the use of bleach is often troublesome as it often detrimentally affects the substrate from which the stain is being removed.

When the defined sulfonamide compounds are used as stain removal agents, in accordance with this invention, the substrate is not adversely affected.

The applicant believes that Chloramine-T has been incorporated into European washing powders in past decades. This Chloramine-T additive may have had some bleaching affect.

BRIEF DESCRIPTION OF THE INVENTION

This invention deals with a process for removing stains from a wide variety of substrates such as wood, polymers, rubbers, textiles, carpets, etc. The process of this invention is particularly concerned with the removal of organic stains such as food and body fluid stains from clothing, bedding and flooring.

Stain removal is widely used in the carpet cleaning and the laundry arts. An area of concern is the removal of food stains from institutional clothing, i.e. the clothing worn by food service workers. Further this invention is particularly useful in the removal of human and animal body fluid stains from bedding and clothing.

Bleach, is a solution of sodium hypochlorite and is the most widely used stain remover. Solutions of sodium hypochlorite have been used, for this purpose, for over 80 years. In the case of clothing, sodium hypochlorite works well provided the clothing is white. In the past almost all institutional clothing was white. In recent years the use of colored institutional clothing has become widespread. The bleaching of stains from colored institutional clothing has proved to be troublesome, as the process which was used to remove the stain often affects the base color of the substrate. For example in the case of a colored food service uniform, with a ketchup stain, the ketchup stain may be removed, however, the color of the uniform around the stain is often altered. In this case; the bleach attacks the stain color and the substrate color indiscriminately and hence the stain color is removed as well as the substrate color, and therefore the uniform is ruined.

Solutions of sodium hypochlorite function as stain removal agents, as a result of their ability to release active chlorine in the form of the Cl+ ion. The Cl+ ion released by sodium hypochlorite is very ionic and hence its action is very harsh. It is this harsh action that affects both the color of the stain and the color of the substrate.

This invention is concerned with the use of solutions of modified aromatic N-halogenated sulfonamides as stain modification agents, that chemically attack stain molecules, weakening or eliminating their affinity for the substrate and therefore rendering them removable. Aromatic N-halogenated sulfonamide compounds when they go into solution, in the presence of foreign organic molecules, release active Cl+ on demand.

The active latent Cl+ ion released by an aromatic N-halogenated sulfonamide compound has been found to be strong enough to remove various stains. Because the stain is not fast, even if it does not remove the stain color, it will alter the stain molecule to render it removable. However, and importantly, the latent ion released by aromatic N-halogenated sulfonamide compounds is not strong enough to affect the color of a dyed substrate. That is, in accordance with this invention, the latent Cl+ ion released by the defined sulfonamide compounds begins a chemical process resulting in the attack of the stain molecules reducing their affinity for the substrate, in particularly body fluid stains on a colored substrate. This attack is strong enough to remove the stain but not strong enough to affect the color of a dyed substrate. The modified stain molecules now can be lifted from the substrate because their bonding affinity for the substrate is substantially weakened. This selective reactivity is particularly true if the base substrate has been dyed with a fast dye.

The use of sulfonamide compounds as stain removal agents is particularly useful in the domestic and industrial laundry arts and in the area of carpet and upholstery cleaning. Solutions of sulfonamide compounds are particularly suited for use on food stains and body fluid stains such as stains resulting from wine, blood, urine, vomit, bile etc.

OBJECTS OF THE INVENTION

An object of this invention is an effective way to remove stains from a substrate. Another object of this invention is a process whereby food stains may be removed from clothing.

Still another object of this invention is a process of removing organic stains from clothing and bedding with a solution which incorporates latent Cl+ ions as an active agent.

A further object of this invention is an effective process for the removal of body fluid stains from flooring, institutional clothing and bedding wherein the active component is a sulfonamide compound.

DESCRIPTION OF THE PREFERRED EMBODIMENT

The subject invention deals with a process whereby stains may be removed from substrates using sulfonamide compounds as stain removal agents.

The use of bleaching agents to bleach a stain from a substrate is and has been the state of the art for at least eighty years.

The most common bleaching agents are solutions of sodium hypochlorite. Solutions of sodium hypochlorite are commonly referred to as bleach. These solutions are effective in that they contain an ionic form of the Cl+ ion. Because the Cl+ ion is ionic it is very effective and indiscriminate as a bleaching agent and capable of removing color from a substrate. That is the ionic Cl+ ion is capable of removing color from a substrate particularly textile substrates. This presents a problem as both the desirable and undesirable coloration is removed from the target substrate, when hypochlorites are used as bleach agents.

For example, if a colored uniform which incorporates a food stain is treated with a solution which incorporates the ionic Cl+ ion, the food stain may be removed however, the color of the base uniform will be affected. In this case if the color of the base uniform is selectively affected, the uniform is unsightly and hence ruined. This problem is acute where the stain removal agent is selectively applied to a stained area i.e. the spraying of a stain removal agent onto a clothing area which includes a body stain.

In accordance with this invention a target stain is removed from a substrate by applying a solution of an aromatic N-halogenated sulfonamide compound to the stained area. In solution an aromatic N-halogenated sulfonamide compounds disassociates to form an active latent Cl+ ion.

Because the active Cl+ ion is latent, its effect on the substrate is minimal and yet it quite effectively alters the stain binding affinity the stain molecules have for the substrate, and hence once altered the stain is removable. Because the base substrate is colored with a fast dye, the substrate is better able to resist change, as is to be compared with a stained area. Aromatic N-halogenated sulfonamide compounds have the ability to remove the coloration from a stained area, or at least molecularly change the stain binding molecules thereby rendering them removable, without altering the coloration of the surrounding substrate.

For example if a colored uniform incorporates a urine stain, when a solution of an aromatic N-halogenated sulfonamide compound is applied to the stain, the urine stain is released and rendered removable without discoloration of the colored uniform.

Chloramine-T has been known and used for over one hundred years and is a widely used sulfonamide compound. Because it produces the active Cl+ ion it has been widely used as a biocide.

The structure of Chloramine-T is as follows:

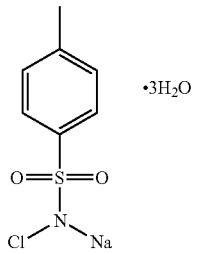

Other newly discovered aromatic N-halogenated sulfonamide compounds which are useful in this invention are in accordance with the below set forth Formula I.

Halo active aromatic sulfonamide organic compounds have been known and used for over one hundred years. The above described Chloramine-T is an example of an old sulfonamide organic compound which has been used in many applications. The usefulness of Chloramine-T is predicated on its ability to release an active Cl+ ion when needed on demand, immediately after which, it simultaneously generates an active aromatic sulfo nitrene companion ion. The active Cl+ ion starts the conversion process of the stain causing molecule, it is immediately assisted by the companion aromatic sulfo nitrene which completes the conversion process. This step two process makes the described halo active aromatic sulfonamides useful agents in stain removal.

As stain removal agents the latent halogen cation ion, prior to release by halo active aromatic sulfonamide organic compounds, in accordance with this invention, is relativity covalent. This relative covalency prevents the Cl+ ion, resulting from an aromatic N-halogenated sulfonamide compound, from prematurely and aggressively reacting and as such prevents the active molecule from having detrimental bleaching properties. Thos end is achieved as the Cl+ ion remains bonded until it is triggered by an encounter with a stain causing molecule.

The new halo active aromatic N-halogenated sulfonamide compounds of Formula I have excellent stain removing properties. In addition many of these compounds have very low toxicity properties which make them attractive for usage, as stain removal agents, in human and, animal environments.

In its broadest sense the subject invention relates to a process for stain removal which comprises treating a stained substrate, with a solution which incorporates an active aromatic N-halosulfonamide.

While any halo active aromatic sulfonamide is functional in accordance with this invention, chloro active sulfonamides are preferred.

The new halo active aromatic sulfonamide compounds which contain at least one halo active sulfonamide group, in accordance with this invention, are in accordance with the following Formula I.

Formula I

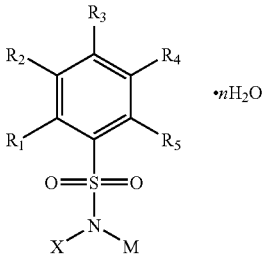

wherein, X is a halogen,

R3 is hydrogen, methyl, or COOM,

R1, R2, R4, R5 are hydrogen, COOH, derivatized COOH, an ester or alkylated amide, COOM, CN, $NO_2$, $SO_3H$ or derivatized $SO_3R$, a halogen, a substituted or unsubstituted phenyl group, a sulfonamide, a halosulfonamide, a straight or branched aliphatic moiety from $C_1$ to $C_{12}$, wherein, the same straight or branched aliphatic moiety may contain substitution at one or more of the aliphatic hydrogens, and R1, R2, R4 and R5 are other than all hydrogen, and M is an alkali or alkaline earth metal.

Other compounds which may be used in this invention are in accordance with Formula I.

wherein, X is a halogen,

R1, R2, R4, R5 are hydrogen, COOH, derivatized COOH, an ester or alkylated amide, COOM, CN, $NO_2$, $SO_3H$ or derivatized $SO_3R$, a halogen, a substituted or unsubstituted phenyl group, a sulfonamide, a halosulfonamide, a straight or branched aliphatic moiety from $C_1$ to $C_{12}$ wherein, the same straight or branched aliphatic moiety may contain substitution at one or more of the aliphatic hydrogens.

R3 is an organic derivatized COOH, such as an ester or alkylated amide, CN, $NO_2$, $SO_3H$ or derivatized $SO_3R$, a halogen, a substituted or unsubstituted phenyl group, a sulfonamide, a halosulfonamide, a straight or branched aliphatic moiety from $C_2$ to $C_{12}$, wherein, the same straight or branched aliphatic moiety may contain substitution at one or more of the aliphatic hydrogens, and M is an alkali or alkaline earth metal.

Further compounds which are useful in stain removal compositions are in accordance with Formula I.

wherein, X is a halogen,

R1, R2, R4, R5 are hydrogen,

R3 is hydrogen, methyl, or COOM, and M is either potassium, rubidium, cesium, lithium or an alkaline earth metal.

Lastly, additional compounds which can be used for stain removal are as per Formula I.

wherein, X is bromine, fluorine, or iodine,

R1, R2, R4, R5 are hydrogen,

R3 is hydrogen, methyl, or COOM, and M is an alkali or alkaline earth metal.

Compounds of Formula I, as described above may or may not be hydrated (n $H_2O$), but are generally isolated as a trihydrate where (n=3).

The compounds of Formula I are very soluble in water. This property allows for easy compounding of stain removing compositions and allows high percentages of the compounds to be formulated into the useful stain removing products.

Further the compounds of Formula I have minimal bleach odor. This property again is highly advantageous, because, formulations with a strong bleach odor are undesirable in many domestic applications.

The stain removal activity of the aromatic chlorosulfonamido group of the compounds of Formula I is regulated by the selection of specific "R" groups. "R" groups adjacent to the chlorosulfonamido group ($R_1$ and $R_5$) can cause steric effects and therefore change activity and/or cause stability changes on the chlorosulfonamido group. In addition the various "R" groups can be effected differently. Specific increases or decreases in activity and, stability may be noted. The usefulness of specific aromatic chlorosulfonamido groups may be affected by their different and unique inductive or resonance effects.

Compounds of Formula I liberate the Cl+ ion, and in doing so also liberate a companion ion an aromatic sulfo nitrene, which also is intimately involved in a reaction to convert the stain molecule to a removable state. When we compare the Cl+ cation produced by bleach, to the Cl+ cation produced by the compounds of Formula I are much more covalent and less ionic than the cation produced by bleach. Therefore, the cations produced by the compounds of Formula I are very selective in their initial reaction as a stain removal or modification agent. The cations of the compounds of Formula I will attack and modify the stain and not the substrate. Further as a result of this covalence the undesirable bleaching side effects resulting from the Cl+ cation produced by the compounds of Formula I are minimized. Therefore, the Cl+ cation produced by the compounds of Formula I can be used as stain removal agents as they do not have adverse side effects. The compounds of Formula I are more stable than bleach, have a higher selectivity as a Cl+ source, and when activated by an attack on a stain causing molecule by its Cl+, further produces an active aromatic sulfo nitrene which also modifies the stain causing molecule in such a manner that it will no longer bond to the substrate. With the stains bonding power changed, the liberated and modified stain molecules can be easily removed from the substrate.

In summary, compared to bleach the compounds of Formula I are superior stain agents because they are more selective, more covalent. Further the backbone companion ion, the aromatic sulfonitrene, remaining after the Cl+ cation is released from the compounds of Formula I, is very active and very selective and immediately contributes its stain removing properties. This backbone companion ion has the ability to further react with stain causing molecules and thereby permanently removing them as a potential stain causing agent. In contrast the chemical moiety which remains after the Cl+ cation is removed from bleach has no ability to react with or tie up stain causing molecules.

Examples of some specific halo active aromatic sulfonamide compounds that are useful as stain removal agents in accordance with this invention are as follows:

1. N-chloro-2-tolylsulfonamide sodium salt having the following Formula:

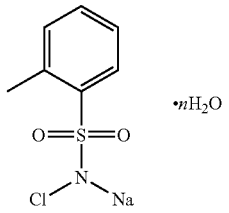

2. N-chloro-4-chlorobenzenesulfonamide sodium salt having the following Formula:

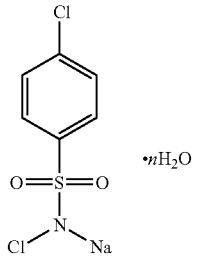

3. N-chloro-2-chlorobenzenesulfonamide sodium salt having the following Formula:

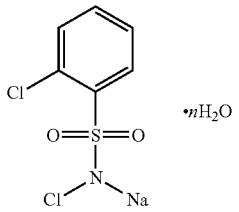

4. N-chloro-4-methoxybenzenesulfonamide sodium salt having the following Formula:

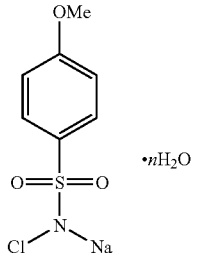

5. N-chloro-2,4,6-mesitylsulfonamide sodium salt having the following Formula:

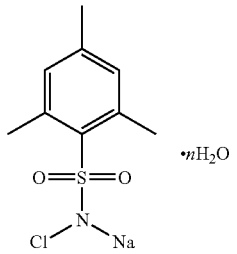

6. N-chloro-4-carboxybenzenesulfonamide disodium salt having the following Formula:

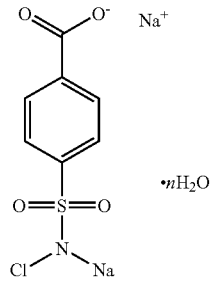

7. N-chloro-4-tolylsulfonamide potassium salt, having the following Formula:

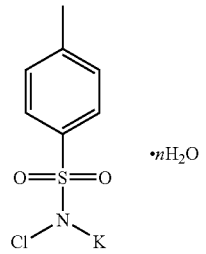

8. N-chloro-4-fluorobenzenesulfonamide sodium salt, having the following Formula:

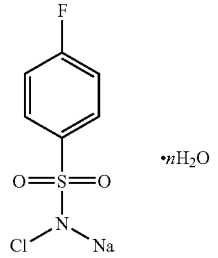

9. and; N-chloro-4-nitrobenzenesulfonamide sodium salt, having the following Formula:

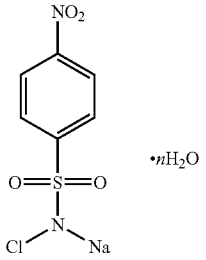

The use of wetting agents with various solutions in order to reduce surface tension is common in the prior art. For example, wetting agents are commonly added to herbical solutions to allow the herbicide to wet out plant leaves, likewise the use of wetting agents with insecticides is common.

Most stain causing molecules are mercaptans, sulfides, nitrogen and/or oxygen based compounds. The compounds of Formula I are excellent agents for eliminating stains which are mercaptan, sulfides, nitrogen and/or oxygen based compounds since both the Cl+ cation and the aromatic sulfo nitrene compounds, which are made available by the compounds of Formula I, react with and modify the stain causing molecules to create chemical compounds which are lightened in color or modified so that they can be easily washed our of the substrate.

In order for the compounds of Formula I to be effective they must come into contact with the substance which is responsible for the stain. If the substance which is responsible for the stain is in an environment which makes access difficult, i.e. pet stains in a carpet, a means must be provided for bringing the selected compound of Formula I into contact with the stain causing substance. In many instances when aqueous solution is used as the delivering medium the solution tends to bead up on the substrate. Therefore, when the water component of the solution evaporates, the substance in solution is deposited only in localized areas. In the case at hand if an aqueous solution of a compound of Formula I were applied to a carpet containing a pet stain, the solution would bead up on or otherwise have difficulty wetting the carpet, such that when the water evaporates the placement of the two reactive components of the molecule would not be available at the stain site and therefore they could not react with the entire stain causing substance on a molecular basis. That is the reaction of the stain removal compound with the stain would be incomplete, and hence the stain removal would be incomplete.

In accordance with one embodiment of this invention a substance is added to the solutions of this invention to reduce the surface tension of the solution. As is discussed above the selected compound of Formula I functions in part by the reaction of the Cl+ moiety with the stain causing molecule. One aspect of this invention is concerned with the fact that many substances which are suitable for reducing the surface tension of the solution may adversely affect the formulated stability of the Formula I compounds or it may degrade the activity of said Cl+ moiety once it is formed.

Suitable substances which are useful for reducing the surface tension of the stain removing solutions of this invention are synthetic and natural wetting agents. Wetting agents are generally classified as cationic, anionic, amphoteric and nonionic. Because there are thousands of natural and synthetic wetting agents it is impossible to make generalizations as to which wetting agent would be effective in the composition of this invention. With this caveat it can be said that generally the most preferred wetting agents for use in accordance with the stain removal compositions of this invention are anionic wetting agents, with the next preferred class of wetting agents being a nonionic wetting agents.

Amphoteric and cationic wetting agents are least preferred wetting agents for use in this invention.

Regardless of the above comments satisfactory agents may be found in any class of wetting agents.

While the applicant is aware of the vast range of wetting agents available, the applicant is not sure of all ramifications of how different wetting agents degrade or reduce the activity of the Cl+ moiety. It is felt that functional groups such as alkenes, alcohol, ketone, especially aliphatic ketones or aldehydes containing at least one alpha hydrogen next to the carbonyl carbon, and phenols as may be contained on the base wetting agent molecule are particularly harmful to the Cl+ moiety. Further while it is impossible for the applicant to explore all the ramifications thereof, impurities as may be contained in various commercially available wetting agents can play a significant part in the degradation of the Cl+ moiety. Impurities which are known to facilitate the degradation of the Cl+ moiety are aromatic and conjugated phenols, compounds containing activated carbonyl, alpha aliphatic hydrogen's or active primary and secondary amines.

The concentration of the wetting agent used in the stain removal solutions of this invention can be from about 0.01 to 5%. A more preferred concentration for the wetting agent is from about 0.01 to about 1.5%. In order to achieve maximum efficiency in the stain removal process of this invention the surface tension of the solution must be reduced, so that the compounds of Formula I can reach and react with the stain causing molecules.

A factor in choosing the wetting agent is the degree to which it foams. If undesirable foaming occurs anti foamers may be added to the solution.

For stability and for optimum performance as a stain removal agent the pH of a solution of the compounds of Formula I should be between 6-14, with a more preferred pH range being between 8-9.5 with a most preferred range being between 8.5-9.

As is discussed above the pH range for stain removal solutions for use in the invention can be from about 6-14. Below a pH of 6 the compounds of Formula I tend to decompose due to the acidic nature of the medium. While the solutions of this invention are effective above a pH of 10.0 solutions having a pH of above 10.0 can only be used for industrial applications, due to their caustic nature.

Aromatic N-Halo active sulfonamide solutions for use in this invention exhibit excellent stability at a pH range of 8-9.5. This stability is important in the domestic applications of this invention where long shelf life is very desirable.

Buffering agents which are suitable for use in accordance with this invention are sodium bicarbonate, potassium bicarbonate, sodium carbonate, potassium carbonate, acetate buffers (such as sodium acetate), phosphate buffers (such as tri and di sodium phosphate) and mixtures thereof, pH blended phosphates, sulfate buffers (such as di and tri sodium sulfate) and mixtures thereof.

Because of price, ease of use, low toxicity and their lack of effect on the environment, the above listed sodium and potassium bicarbonates are preferred buffering agents for use in this invention. Buffered solutions are advantageous in that the active ingredients of the stain removal solution of this invention are stable over very long periods of time.

The concentration of the buffering agent can be from 0.1% up to the limit of solubility. The preferred range for the concentration of the buffering agent is from about 5% to about 200% of the active compound in solution. A more preferred range is from about 10% to about 100% with a most preferred concentration being 25-75%.

The buffering of the solution compensates for any change in pH that may result from the conditions of application, the type of substrate, or industrial waste and the nature of the stain causing molecule.

For the industrial stain removal it is preferred that the concentration of a compound of Formula I in stain removal formulations, be about 1-100%. For residential consumer use the concentration of the active ingredient can be from about 0.1 to about 2.0%, with a more preferred range being from about 0.3 to about 1.0% percent, with the most preferred concentration being 0.50%. These lower concentrations keep the bleach like odor to a minimum but still give the desired stain removal.

As with all household formulations, it is at times desirable to have a very faint but highly attractive scent associated with its application. Therefore, trace amounts of compatible perfume additives may be used in the formulations of this invention.

As is discussed above of the compounds of the general Formula I function as stain removing agents. The data below demonstrates that the defined aromatic N-halo sulfonamides will assist in the removal of stains, regardless of the specific substation on the structure of Formula I. This data demonstrates that it is the aromatic N-halo sulfonamide compound is the active component effecting the stain removal and the various "R" group combinations will give greater or lesser degrees of stain removal for a given stain problem. The aromatic N-halo sulfonamide is the only common chemical grouping in each of the Formulas. It is safe to say that all aromatic N-halo sulfonamides will show some activity on all stains and conversely a specific N-halo sulfonamide may or may not have the same activity with all stains.

It has been found that if the stain removing compositions of this invention further incorporate small percentages of a low molecular weight alcohol, the activity of the stain modification and stain lifting ability followed by the removal process is enhanced.

An example of a suitable alcohol which is useful in conjunction with this aspect of the invention is t-butanol. The effect of the alcohol can manifest itself in many ways. The alcohol enhances the stain removal activity of the active aromatic N-halo sulfonamide group. T-butanol or related tertiary alcohols are preferred additives because they do not contain hydrogen atoms alpha to the oxygen alcohol moiety, and therefore offer more stable formulations. The Alpha hydrogens can detract from the stability of the formulations due to interaction with the active halogen contained in the active aromatic halo sulfonamide. However, at pH>10 alcohols containing alpha hydrogens, such as ethanol and isopropanol, were found to be stable in stain removal formulations. In fact, the aromatic N-halo active sulfonamides are stable at high concentrations of alcohols (>50%) at pH>10.

The alcohol can be present at concentrations of from about 0.1 to about 80 weight percent, a more preferred range is from about 0.1 to about 2.0 weight percent with a most preferred range being from about 0.2 to about 1.0 weight percent.

While the applicant does not understand all of the ramifications of why certain alcohols enhance the stain removal activity of the compounds of Formula I, it would appear as though the most functional alcohols are those with no hydrogens alpha to the oxygen moiety of the alcohol i.e. CH or $CH_2$ groups next to OH group.

Pet stains are very troublesome. Pet stains which originate with pets can be caused by urine, vomit, solid waste, or territorial spray etc. Stains which are caused by pet urine, urine are of primary concern. Urine is approximately 96% water and 4% solids. The solids remaining after the water evaporates can contain:

Uric acid,
Urea,
Creatine,
"Purines", (mainly converted to Allantoin)
Proteins
Various Enzymes,
Citrates,
Other detoxified chemicals
Ammonia,
Electrolytes such as sodium chloride, potassium chloride, calcium chloride, magnesium chloride, various phosphates, sulfates and other organic salts and complexes.

Many pet stains which originate with pet urine also have a pigment component. This pigment may be uroerythrin, urobilin, urochrome, etc. Most of these pigments originate with the bile which results from the metabolism of solids in the digestion of various proteins, these pigments are yellow, orange, or orange to black in color.

The amounts and ratios of the above components which comprise urine vary depending on diet, the biochemistry, the stress level of the animal, the kind of animal, the age of the animal, the sex of the animal and other factors.

Once excreted by the animal, the stains of the described animal liquids are not stable. Bacteria decompose the organic components as well as the pigment compounds of these liquids. For this reason after time the "ammonia" type odor characteristic of a urine stain, becomes more intense. In the second stage of the decomposition process mercaptans are emitted resulting in the ammonia/skunk type odor of "old" urine.

The process whereby staining is effected by an animal liquid is in accordance with the following: in the first stage of the staining process of the water component is evaporated. The organic components are most often totally water-soluble when they are secreted by the animal. A liquid containing no solid materials is deposited on the substrate, wood floor, carpet, title etc. In time these components are modified by exposure to air and "add on dirt" which produce a stain that is not water soluble. This change occurs when the solid components are produced from the evaporation of the water portion of the urine and are subsequently exposed to the air (oxygen) and bacteria. The now concentrated organic components are continually changing, and these components have a strong tendency to attract dirt. The combination of the concentrated but changing solid residue with urine based pigments is a problem. These pigments further attract dirt, which intensifies the stain.

The stain itself is bound to the substrate (carpet, wood floor, drapes, etc.) and becomes increasingly more apparent as it continues to attract organic and inorganic chemical components. The "chemical functionality" of the organic components left by the animal is essentially the same in their now solid form as they were when they were in the liquid. As such the organic components of the original urine stain contain molecules are largely bound to the substrate as nitrogen, sulfur and oxygen based organics which will react with sulfonamide compounds. Once the stain causing molecules are chemically altered by an aromatic N-chloro sulfonamide compound, they are changed in such a manner that they can release themselves from the substrate to which they are attached. In this form they can easily be removed from the substrate and hence the stain removed us effected.

That is when aromatic N-chloro sulfonamide moieties bond with the protein components of pet stains those components are changed permanently and irreversibly. They are now much easier to remove with conventional and simple washing techniques because they are no longer able to attach strongly to a substrate and attract and retain debris and they even at times become lighter in color or color neutral. The debris attracted by the protein components will still be in the substrate but because the debris is now loosely bonded it can be removed with a damp sponge.

The easiest and most effective way of applying the aromatin N-chloro sulfonamide compound to a substrate is to spray the stained area with a solution of the sulfonamide component, containing an effective concentration of the sulfonamide compound.

The solution of sulfonamide compound is then allowed to stand on the substrate for an effective period of time. This effective period of time can be from about 1 min. to about 12 hours or longer.

For use in accordance with this invention the stain removal solution which is used in the process of this invention must incorporate an effective amount of aromatic N-chloro sulfonamide compounds. Solutions containing from about 0.05 to about 5 weight percent of sulfonamide compounds have been found to be effective in stain removal.

A more preferred concentration for the sulfonamide compound for use in this invention is from about 0.25 to about 2 weight percent. A most preferred concentration for the sulfonamide compound for use in this invention is from about 0.4 to about 1.0 weight percent, with a most preferred concentration for the sulfonamide compound being 0.75 weight percent.

In addition to being an excellent stain removal agent sulfonamide compounds, due to their biocidal and fungicidal properties, the aromatic N-chloro sulfonamide compounds kill any bacteria and/or fungus as may be contained on the substrate from which the stain is being removed. Further aromatic N-chloro sulfonamide compounds after removing the stain leaves traces of the aromatic N-chloro sulfonamide compounds on the substrate which inhibits future bacterial and/or fungicidal activity.

In addition to effecting stain removal by spraying a substrate with a solution of a sulfonamide compound stain removal may be effective in accordance with this invention by applying a slurry paste of the sulfonamide compound to the stain.

For use in this invention aqueous solutions of aromatic N-chloro sulfonamide compounds are preferred, however, solutions which are based on other solvents may be used.

EXAMPLES

The following examples will illustrate the stain removal in accordance with the subject invention. These examples are given for purposes of illustration and not for purposes of limiting this invention.

More particularly the below listed Examples illustrate the general utility of N-Halogenated aromatic sulfonamides in stain removal. For purposes of conducting the test in accordance with the below listed Examples a series of stained substrates were prepared. The utilized stained substrates are in accordance with the following:

Example #1

Two 50 oz. plush cut, very light tan colored, polyester carpet samples, prepared as described above, were prepared. Both carpet samples were stained with commercially available hunters fox urine concentrate, at room temperature by spraying the fox urine concentrate, as sold by the Wildlife Research Company of Minone, Minn. Under the designation red fox urine to one of the carpet samples in a circular area approximately 6 inches in diameter. Both samples were allowed to stand in a laboratory hood until dry. The treated carpet samples were then allowed to age further on a floor in the high traffic laboratory floor for approximately 150 hours. Following this exposure one of the carpet samples was sprayed with approximately 10 grams of solution A until damp to the touch.

Solution A:

| | |
|---|---|
| N-chloro-4-carboxybenzenesulfonamide disodium salt | 0.42% |
| t-butanol | 0.5% |
| $Na_2CO_3$ | 0.3% |
| Avanel S74 | 0.03% |
| Fragrance | 0.06% |
| Water | 98.69% |
| pH | 9.2 |

Both carpet samples were then washed with identical very dilute household detergent solutions. The carpet sample not treated with Solution A maintained a noticeable image of the stained area. The treated carpet sample did not have a detectable stain image of the stained area.

Example #2

The same polyester carpet samples of Example 1 stained with fox urine as above were treated as above with a sulfonamide solution of Solution B.

Solution B

| | |
|---|---|
| N-chloro-4-carboxybenzenesulfonamide disodium salt | 0.42% |
| t-butanol | 0.5% |
| $Na_2CO_3$ | 0.3% |
| Avanel S74 | 0.03% |
| Fragrance | 0.06% |
| Water | 98.19% |
| pH | 9.2 |

The samples were then washed with a detergent solution in accordance with the procedure of Example 1. In contrast the non treated carpet sample had a noticeable stain outlined area.

Example 3

A sample of wool persian carpet which had been stained repeatedly by cat urine over a period of days was utilized. Numerous attempts were made to remove the stain using dilute solutions of household detergent and water without success. The stained area was sprayed with Solution A. The stain was rubbed and blotted dry with a dry towel, the detectable stain image on the stained area was removed.

Example 4

A white Berber carpet which was stained by dog urine was utilized. Numerous attempts were made to remove the stain using dilute solutions of household detergent and water without success. The stain was sprayed as above with Solution A. The stain was blotted and rubbed lightly with a water dampened sponge. After blotting dry with a dry towel, the carpet did not have a detectable stain image of the stained area.

Example 5

A light weight carpet which was repeatedly stained by dog urine was utilized. Numerous attempts were made to remove the stain using dilute solutions of household detergent and water without success. The stain was sprayed as above with Solution A. The stain was blotted and rubbed lightly with a water dampened sponge. After blotting dry with a dry towel, the carpet did not have a detectable stain image.

What is claimed is:

1. A process for removing a stain from a substrate which comprises treating the substrate with a solution containing an effective amount of a halo active aromatic sulfonamide compound having the formula:

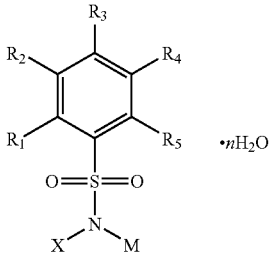

wherein X is a halogen;

$R_3$ is methyl or COOM;

$R_1$, $R_2$, $R_4$, and $R_5$ are independently hydrogen, COOH, derivatized COOH, an ester or alkylated amide, COOM, CN, $NO_2$, $SO_3H$, a halogen, a substituted or unsubstituted phenyl group, a sulfonamide, a halosulfonamide, a straight or branched aliphatic moiety from $C_1$ to $C_{12}$, wherein the same straight or branched aliphatic moiety may contain substitution at one or more of the aliphatic hydrogens;

$R_1$, $R_2$, $R_4$, and $R_5$ are other than all hydrogen;

M is an alkali or alkaline earth metal;

and n is the number of water molecules per molecule of the halo active aromatic sulfonamide compound.

2. The process of claim 1 wherein the solution further incorporates an effective amount of a wetting agent which essentially does not react with the sulfonamide compound.

3. The process of claim 1 wherein the substrate is a member selected from the group consisting of clothing, bedding and flooring.

4. The process of claim 2 wherein the substrate is a member selected from the group consisting of clothing, bedding and flooring.

5. The process of claim 3 wherein the substrate is carpeting.

6. The process of claim 3 wherein the substrate is clothing.

7. The process of claim 3 wherein the substrate is flooring.

8. The process of claim 1 wherein the concentration of the sulfonamide compound is from about 0.2 to about 10 weight percent.

9. The process of claim 2 wherein the concentration of sulfonamide compound is from about 0.2 to about 10 weight percent.

10. The process of claim 3 wherein the concentration of sulfonamide compound is from about 0.2 to about 10 weight percent.

11. The process of claim 4 wherein the concentration of sulfonamide compound is from about 0.2 to about 10 weight percent.

12. The process of claim 5 wherein the concentration of sulfonamide compound is from about 0.2 to about 10 weight percent.

13. The process of claim 2 wherein the wetting agent is an anionic or nonionic wetting agent.

14. The process of claim 2 wherein the wetting agent is an anionic wetting agent.

15. The process of claim 4 wherein the wetting agent is an anionic or nonionic wetting agent.

16. The process of claim 1 wherein the solution is buffered to a pH of from about 7 to about 10.

17. The process of claim 2 wherein the solution is buffered to a pH of from about 7 to about 10.

18. The process of claim 3 wherein the solution is buffered to a pH of from about 7to about 10.

19. The process of claim 4 wherein the solution is buffered to a pH of from about 7 to about 10.

20. The process of claim 5 wherein the solution is buffered to a pH of from about 7 to about 10.

21. The process of claim 1 wherein the pH of the solution is buffered to a pH of greater than 10.

22. The process of claim 1 wherein the solution further incorporates an effective amount of a low molecular weight alcohol.

23. The process of claim 2 wherein the solution further incorporates an effective amount of a low molecular weight alcohol.

24. The process of claim 8 wherein the solution further incorporates an effective amount of a low molecular weight alcohol.

25. The process of claim 9 wherein the solution further incorporates an effective amount of a low molecular weight alcohol.

26. The process of claim 1 wherein the sulfonamide compound has the following Formula:

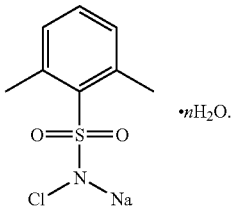

27. The process of claim 26 wherein the pH of the solution is buffered to a pH of from about 7 to about 10.

28. The process of claim 26 wherein the pH of the solution is buffered to a pH of greater than 10.

29. A process for removing a stain from a substrate which comprises treating the substrate with a solution containing an effective amount of a halo active aromatic sulfonamide compound having the formula:

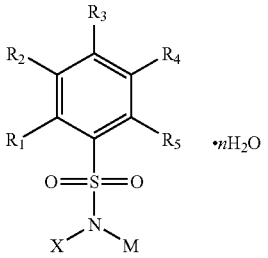

wherein X is a halogen;

$R_1$, $R_2$, $R_4$, and $R_5$ are hydrogen;

$R_3$ is COOM, Cl, F, or $NO_2$;

M is either potassium, rubidium, cesium, lithium or an alkaline earth metal; and n is the number of water molecules per molecule of the halo active aromatic sulfonamide compound.

30. The process of claim 29, wherein the sulfonamide compound has the following Formula:

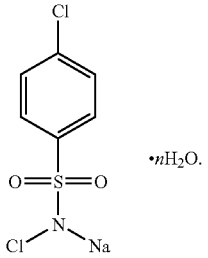

31. The process of claim 29, wherein the sulfonamide compound has the following Formula:

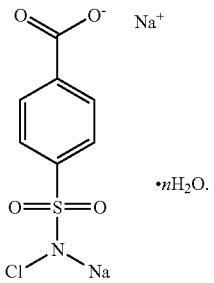

32. The process of claim 29 wherein the sulfonamide compound has the following Formula:

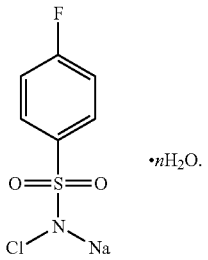

33. The process of claim 29 wherein the sulfonamide compound has the following Formula:

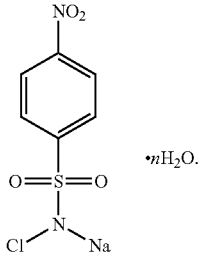

34. The process of claim 31 wherein the pH of the solution is buffered to a pH of from about 8 to about 9.5.

35. The process of claim 32 wherein the pH of the solution is buffered to a pH of about 8 to about 9.5.

36. The process of claim 33 wherein the pH of the solution is buffered to a pH of from about 8 to about 9.5.

37. The process of claim 29 wherein the pH of the solution is buffered to a pH of from about 7 to about 10.

38. The process of claim 29 wherein the pH of the solution is buffered to a pH of the solution is buffered to a pH of from about 8 to about 9.5.

39. The process of claim 29 wherein the pH of the solution is buffered to a pH of greater than 10.

40. A process for removing a stain from a substrate which comprises treating the substrate with a solution containing an effective amount of a halo active aromatic sulfonamide compound having the formula:

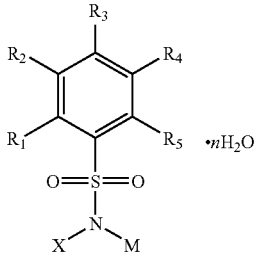

wherein X is chlorine;

$R_1$, $R_2$, $R_4$, and $R_5$ are hydrogen $R_3$ is COOM

M is sodium; and n is the number of water molecules per molecule of the halo active aromatic sulfonamide compound.

41. A process for removing a stain from a substrate which comprises treating the substrate with a solution containing an effective amount of a halo active aromatic sulfonamide compound having the following Formula:

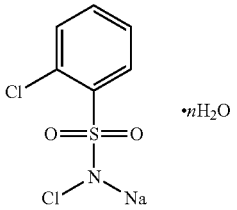

wherein n is the number of water molecules per molecule of the halo active aromatic sulfonamide compound.

* * * * *